United States Patent [19]

Dunstan

[11] Patent Number: 4,815,290

[45] Date of Patent: Mar. 28, 1989

[54] HEAT RECOVERY SYSTEM

[76] Inventor: Lyle A. Dunstan, 5105 NW. 137th Ave., Portland, Oreg. 97229

[21] Appl. No.: 81,946

[22] Filed: Aug. 5, 1987

[51] Int. Cl.[4] ..... F02G 1/04

[52] U.S. Cl. ..... 60/517; 60/516; 60/682

[58] Field of Search ..... 60/516, 517, 650, 682

[56] References Cited

FOREIGN PATENT DOCUMENTS 2936912 4/1981 Fed. Rep. of Germany ..... 60/517

*Primary Examiner*—Allen M. Ostrager

*Attorney, Agent, or Firm*—Olson and Olson

[57] ABSTRACT

A heat recovery system utilizing the principle of the Stirling engine includes a gas-containing chamber communicating through control valves alternately with hot and cool gas heat exchangers supplied with waste or other source heat fluid and coolant fluid, respectively, and a blower functions to circulate gas in the chamber alternately through the hot and cool gas heat exchangers and thus alternately to increase and decrease the gas pressure in the chamber. This alternate changing of gas pressure is utilized to operate a work-performing device. In one embodiment, a single chamber contains a piston reciprocative therein by said pressure change. In another embodiment, each of a pair of chambers is coupled through a blower selectively with a hot gas heat exchanger and a cool gas heat exchanger. Control valves govern the delivery of hot gases sequentially first to one and then the other of the pair of chambers while simultaneously delivering cool gases sequentially first to the other and then to the one of the pair of chambers. As each chamber is filled with hot gases the increased gas pressure is caused to flow from the hot chamber to the cold chamber through a gas turbine or other gas-operated power device for performing work.

13 Claims, 2 Drawing Sheets

HEAT RECOVERY SYSTEM

BACKGROUND OF THE INVENTION

This invention relates to heat recovery systems for converting waste or other source heat to usable power, and more particularly to an improved heat recovery system based upon the principle of the Stirling engine.

Heat recovery systems heretofore have required association with systems wherein sufficient amounts of high temperature waste heat are available, so that conventional steam turbines may produce usable power at a practicable degree of efficiency. This requirement necessarily limits the number and locations of available sources of waste heat.

SUMMARY OF THE INVENTION

In its basic concept, this invention utilizes a source of relatively low temperature waste heat to heat a gas which is delivered by a blower to a gas chamber to increase the pressure in the chamber, and alternately to deliver cool gas to the chamber to decrease the pressure in the chamber, the resulting high gas pressure developed in the alternately heated and cooled gas in the chamber being utilized as a source of power.

It is by virtue of the foregoing basic concept that the principal objective of this invention is achieved; namely, to avoid the aforementioned disadvantages and limitations of utilizing waste heat in conventional steam systems.

Another objective of this invention is the provision of a heat recovery system of the class described that is capable of deriving usable amounts of power from a wide variety of relatively low temperature waste heat sources.

Still another objective of this invention is to provide a heat recovery system of the class described that produces significant amounts of usable power at high efficiency and low cost.

A further objective of this invention is the provision of a heat recovery system of the class described that permits rapid control of power production without awaiting adjustment of thermal input.

A still further objective of this invention is the provision of a heat recovery system of the class described that is of relatively simplified and economical construction, requiring minimum maintenance and repair.

The foregoing and other objects and advantages of this invention will appear from the following detailed description, taken in connection with the accompanying drawings of preferred embodiments.

DESCRIPTION OF THE PREFERRED EMBODIMENTS

Figure 1:
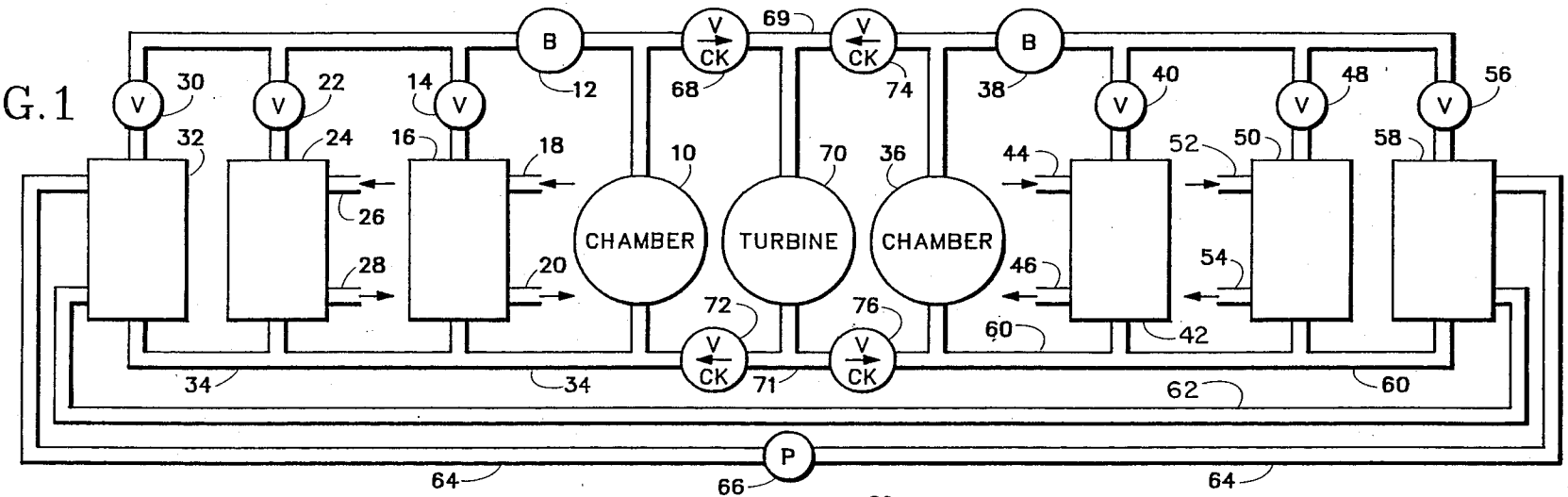
FIG. 1 is a schematic diagram of a heat recovery system embodying the features of this invention.

FIG. 1 of the drawings illustrates a two chamber system in which each chamber is provided with its own set of hot and cool heat exchangers and its own blower to circulate a volume of gas selectively through the heat exchangers, one at a time as determined by the selective operation of associated control valves. The volume of the chambers should be large with respect to the volume of the heat exchangers so that the average hot and cold temperatures achieved in the system are not seriously degraded by the inclusion of a volume of gas in a heat exchanger opposite in temperature to the desired temperature.

Figure 2:
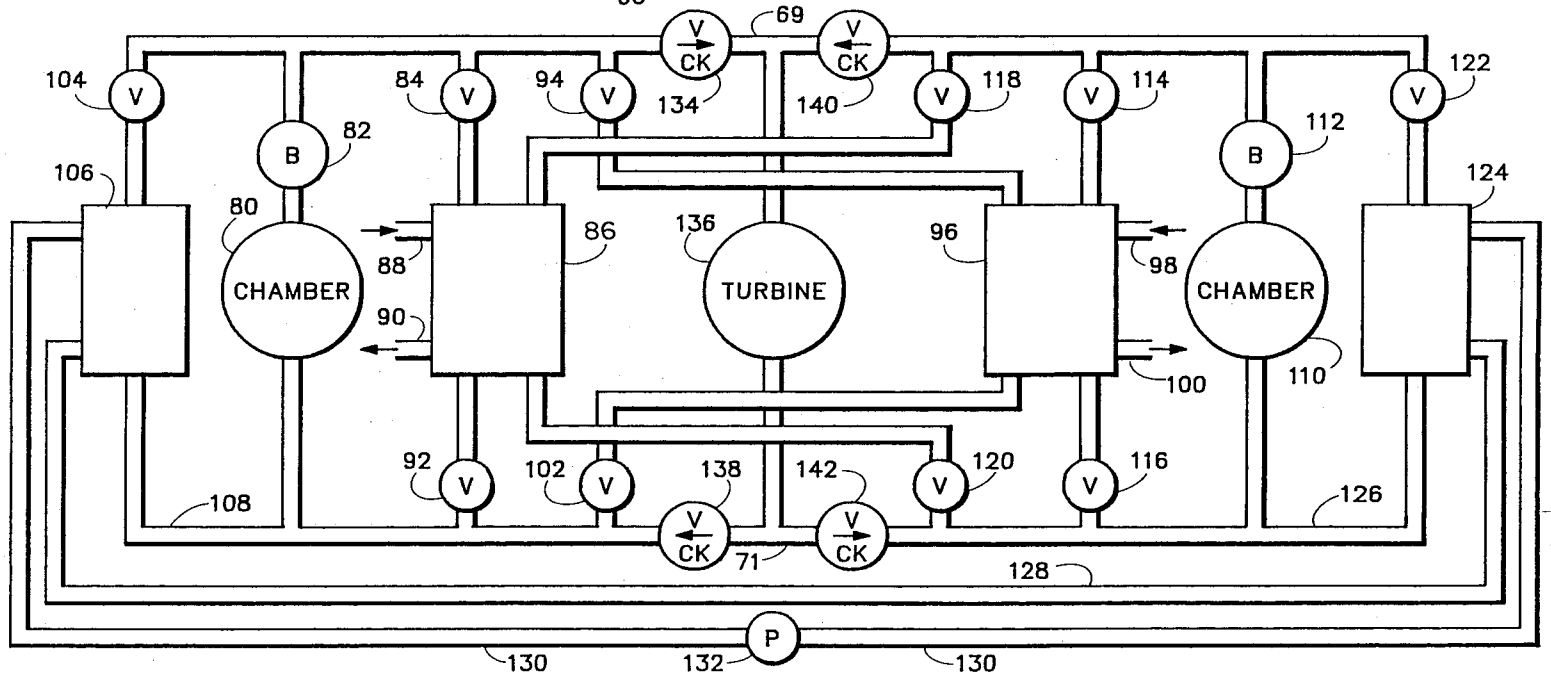
FIG. 2 is a schematic diagram of a second embodiment of a heat recovery system of this invention.

FIG. 2 illustrates a two chamber system in which the chambers share common hot and cool heat exchangers. The economy resulting from the use of fewer heat exchangers of lesser rating because of their greater percentage of active time, is offset by the higher cost of the greater number of control valves of nearly leak proof quality and requirement to be capable of withstanding the comparatively high pressure differences between chambers, rather than merely blower pressures as in the system of FIG. 1. Another economy for this system as compared with the system of FIG. 1 is that smaller chambers may be employed since the average chamber temperatures are not degraded by inclusion of a heat exchanger of a temperature opposite to the desired temperature.

Figure 3:
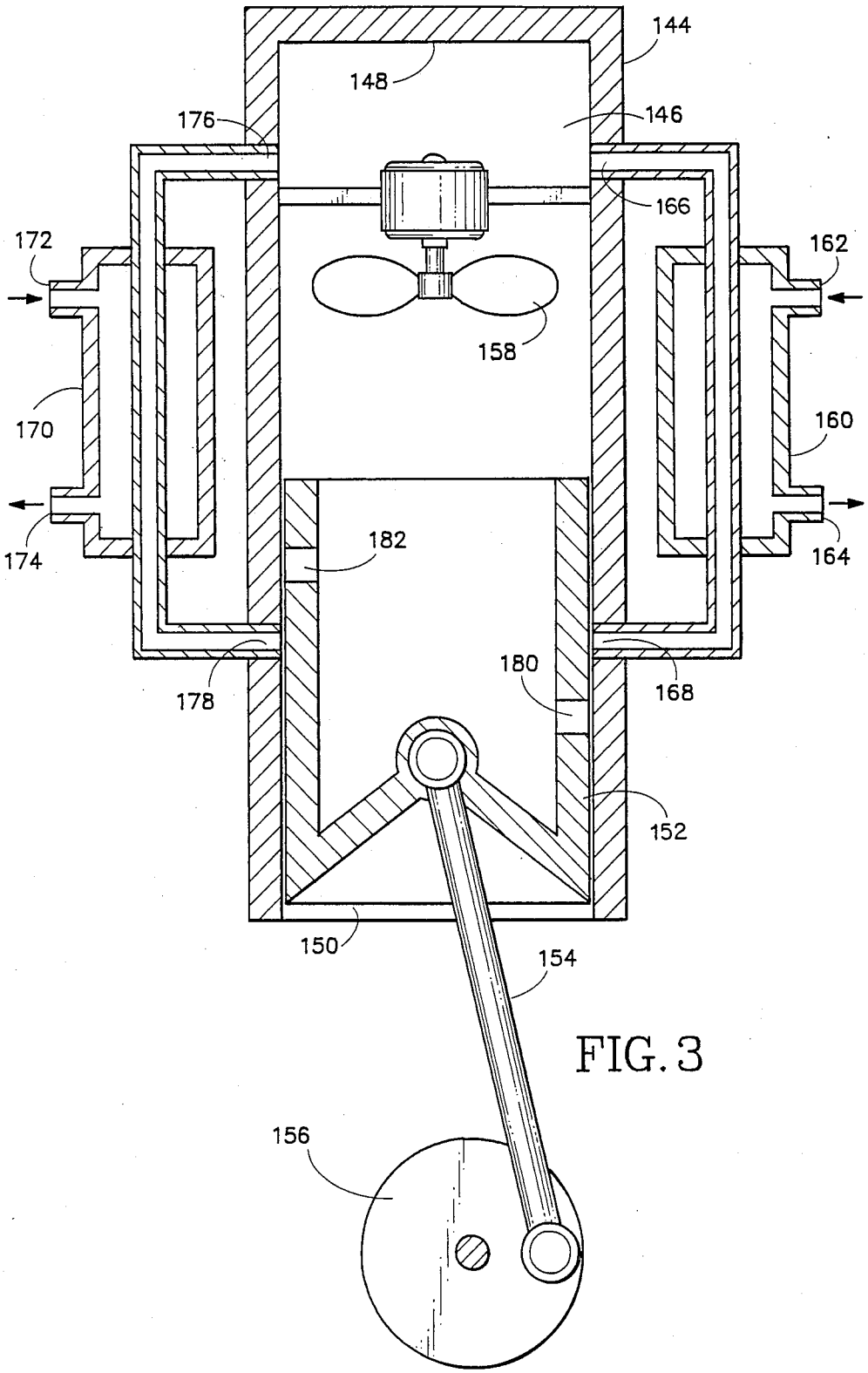
FIG. 3 is a schematic diagram of a third embodiment of a heat recovery system of this invention.

FIG. 3 illustrates a single chamber system in which a reciprocative piston operates to communicate the chamber alternately with hot and cool heat exchangers.

Referring now particularly to FIG. 1 of the drawings, gas chamber 10 communicates through a conduit with blower 12 by which gases are moved through the system. Electrically activated control valve 14 controls the delivery of such gases through the heat exchange passageway section of hot heat exchanger 16. The heat transfer fluid circulating section of the heat exchanger includes inlet conduit 18 adapted to communicate with a source of hot gas or liquid, preferably representing waste heat, and outlet conduit 20 for the recycling or exhausting of such waste heat fluid.

Electrical control valve 22 controls the delivery of gases from blower 12 through the heat exchange passageway section of the cool heat exchanger 24. The heat transfer fluid circulating section of the heat exchanger is provided with inlet conduit 26 which is arranged to communicate with the source of cold air or other gas or liquid, and outlet conduit 28 for the recycling or exhausting of the cold fluid.

The embodiment of FIG. 1 also includes an electrically actuated valve 30 for delivering gases from the blower 12 through the heat exchange passageway section of the intermediate temperature heat exchanger 32 which is described more fully hereinafter.

Return conduit 34 communicates the opposite end of the heat exchange passageway sections of the hot, cool and intermediate temperature heat exchangers to the end of gas chamber 10 opposite the connection with the blower 12.

In manner similar to the foregoing, the second gas chamber 36 of the pair communicates with blower 38 by which gases are circulated through heat exchangers. Thus, electrically controlled valve 40 controls the passage of gases through the heat exchange passageway section of a hot heat exchanger 42 the heat transfer fluid circulating section of which is provided with inlet conduit 44 for introducing waste heat and outlet conduit 46 for the recycling or exhausting of the waste heat. Electrically controlled valve 48 controls the delivery of gases from the blower 38 through the heat exchange passageway section of cool heat exchanger 50 the heat transfer circulating section of which is provided with inlet conduit 52 and outlet conduit 54 for the circulation of cold air or other gas or liquid.

Electrically controlled valve 56 controls the passage of gas through the heat exchange passageway section of intermediate heat exchanger 58.

Return conduit 60 communicates the heat exchange passageway sections of the hot, cold and intermediate heat exchangers to the end of gas chamber 36 opposite the communication with blower 38.

The heat transfer fluid circulating sections of the intermediate temperature heat exchangers 32 and 58 are coupled together through conduits 62 and 64, and circulating pump 66 in the conduit 64 functions to circulate the heat transfer fluid through the circulating sections.

In the embodiment illustrated in FIG. 1, gas chamber 10 communicates through outlet check valve 68 and a high pressure manifold conduit 69 with the inlet of a turbine 70. The turbine functions as a gas pressure-operated work-performing device, such as the power source for an electric generator. The exhaust end of the turbine communicates through low pressure manifold 71 and check valve 72 with return conduit 34.

In similar manner, chamber 36 communicates through outlet check valve 74 and high pressure manifold 69 with the inlet of the turbine 70 the exhaust end of which is coupled through the low pressure manifold 71 and check valve 76 to the return conduit 60.

In the following description of the operation of the heat recovery system illustrated in FIG. 1, let it be assumed that the cycle begins with the closing of control valves 22 and 30 and the opening of control valve 14. Accordingly, blower 12 causes gas in chamber 10 to circulate through the hot heat exchanger 16, thereby raising the temperature of the gas in chamber 10. Simultaneously, control valves 40 and 56 are closed and control valve 48 is open, allowing the blower 38 to circulate gas in chamber 36 through the cold heat exchanger 50 and thus cool the gas in chamber 36.

The hot gas in chamber 10 being at a higher pressure than the cool gas in chamber 36, the higher pressure gas flows through the check valve 68 to the inlet of the turbine 70, producing power, and thence out through the exhaust through check valve 76 to chamber 36. The exhaust gases from the turbine cannot pass through check valve 72 because the gas in chamber 10 is at higher pressure.

Next, control valves 14 and 48 are closed and control valves 30 and 56 are opened to allow the blower 12 to circulate gas in chamber 10 through the intermediate temperature heat exchanger 32. At the same time blower 38 circulates the gas in chamber 36 through the intermediate temperature heat exchanger 58. The heat transfer fluid through heat exchangers 32 and 56 circulates through both exchangers by the recirculating pump 66. Accordingly, heat is transferred from chamber 10 which is being cooled to chamber 36 which is being heated.

Next, control valves 30 and 56 close and control valves 22 and 40 open to cool chamber 10 and heat chamber 36. This results in chamber 36 being at higher pressure than chamber 10 and therefore the higher pressure gas flows from chamber 36 through the check valve 74 to the inlet of turbine 70, producing power. The exhaust from the turbine flows through check valve 72 to the chamber 10.

Next, control valves 22 and 40 close and valves 30 and 56 open to transfer heat from chamber 36 to chamber 10 by operation of the intermediate temperature heat exchangers 32 and 58 and recirculating pump 66.

Finally, control valves 30 and 56 close and control valves 14 and 48 open to initiate the second cycle of operation of the system, as described hereinbefore.

Referring now to the embodiment illustrated in FIG. 2 of the drawings, gas chamber 80 communicates with blower 82 by which gases are delivered to heat exchangers. Thus, the electrical control valve 84 controls the delivery of gases from chamber 80 to the heat exchange passageway section of cool heat exchanger 86. The heat transfer fluid circulating section of this exchanger is provided with inlet conduit 88 and outlet conduit 90 for the circulation of cold air or other gas or liquid. Electrically controlled return valve 92 serves to return the gases to chamber 80.

Electrically controlled inlet valve 94 serves to control the delivery of gases from chamber 80 to the heat exchange passageway section of hot heat exchanger 96. The heat transfer fluid circulating section of this heat exchanger is provided with inlet conduit 98 and outlet conduit 100 for the circulation of hot gases, preferably derived from a source of waste heat. Electrically controlled return valve 102 serves to return the gases to chamber 80.

Electrically controlled valve 104 controls the delivery of gases from chamber 80 to the heat exchange passageway of heat exchanger 106. Return conduit 108 serves to return the gases from valves 92 and 102 and intermediate heat exchanger 106 to the end of gas chamber 80 opposite the blower 82.

In similar manner, the second chamber 110 of the pair communciates with blower 112 by which gases are delivered selectively to various heat exchangers. Thus, electrically controlled inlet valve 114 controls the delivery of gases from chamber 110 to the hot heat exchanger 96, while electrically controlled return valve 116 returns the gases to chamber 110. Electrically controlled inlet valve 118 controls the delivery of gases to the cool heat exchanger 86, while such gases are returned to the chamber 110 by way of electrically controlled return valve 120. Electrically controlled valve 122 controls the delivery of gases from chamber 110 to the heat exchange passageway section of intermediate heat exchanger 124. Return conduit 126 provides for the return of gases from valves 116, and 120 and intermediate heat exchanger 124 to the end of gas chamber 110 opposite the blower 112.

The heat transfer fluid circulating sections of the intermediate heat exchangers 106 and 124 are connected together through conduits 128 and 130, and pump 132 in conduit 130 serves to circulate the heat transfer fluid.

Outlet check valve 134 allows high pressure gases in chamber 80 to pass to the inlet of turbine 136. The exhaust end of the turbine communicates through return check valve 138 to gas chamber 80. Similarly, outlet check valve 140 affords the passage of hot high pressure gases in chamber 110 to pass to the inlet of the turbine. The exhaust end of the turbine communicates through check valve 142 and return conduit 126 with the end of gas chamber 110 opposite the blower 112.

To illustrate the operating cycle of the heat recovery system of FIG. 2, let it be assumed that the cycle starts with control valves 97, 102, 104, 118, 120 and 122 closed and control valves 84, 92, 114 and 116 open. Blower 82 thus circulates gas in chamber 80 through the cold heat exchanger 86 while blower 112 circulates gas in chamber 110 through the hot heat exchanger 96. This results in higher pressure in chamber 110 and lower pressure in chamber 80, so that gas flows from chamber 110 through the check valve 140 to the inlet of turbine 136. The gases flow from the exhaust end of the turbine through check valve 138 to chamber 80.

Next, all control valves are closed except valves 104 and 122. Blower 82 now circulates gas in chamber 80 through the intermediate temperature heat exchanger 106 and blower 112 circulates gas in chamber 110 through the intermediate temperature heat exchanger 124. By operation of the circulating pump 132, heat is transferred from chamber 110 to chamber 80. The gas in chamber 80 thus is heated and the gas in chamber 110 is cooled, without either supplying source heat to the system or rejecting heat from the system.

Next, control valves 84, 92, 104, 114, 116 and 122 are closed and valves 94, 102, 118 and 120 are opened. This allows blower 82 to circulate the gas in chamber 80 through the hot heat exchanger 96 and blower 112 to circulate gas in chamber 110 through cold heat exchanger 86. This raises the temperature and pressure in chamber 80 while lowering the pressure in chamber 110. Gas thus flows from chamber 80 through the check valve 134 to the inlet of the turbine 136, and thence through the exhaust of the turbine through check valve 142 to chamber 110.

Next, all control valves are closed except valves 104 and 112. Heat thus is transferred from chamber 80 to chamber 110 by operation of the circulating pump 132 in the manner previously described. Gas in chamber 80 thus becomes cooled to some intermediate temperature and the gas in chamber 110 becomes warmed to an intermediate temperature.

Finally, control valves 94, 102, 104, 118, 120 and 122 are closed and control valves 84, 92, 114 and 116 are opened, thereby returning the system to the condition initiating the second cycle of operation.

From the foregoing it will be apparent that there are four phases to a complete cycle and that the cold and hot heat exchangers are active during two of the phases. Assuming the phases to be of equal time, heat exchanger 86 would require a rating of twice the average heat input. By comparison, for the situation illustrated in FIG. 1, the heat exchangers 16 and 42 would each have a rating of four times the average heat input.

Omission of the intermediate temperature heat exchangers results in two phases per cycle and smaller rating of the heat exchangers.

For mathematical analysis of the system of FIG. 1, let it be assumed that the average hot temperature will reach 350° F., the average cold temperature will reach 100° F. and there is a 15° F., drop to the intermediate temperature heat exchanger. Accordingly, mathematical analysis shows that the Btu through the turbine as compared to the total Btu furnished by the hot heat exchanger is approximately 44.44%. If the intermediate temperature heat exchangers 32 and 58 are omitted from the system, the ratio of Btu through the turbine compared to total Btu input would be 30.86%.

By comparison, for a conventional steam system supplying the turbine with steam at 1200 psia and 950° F. and exhausting to a back pressure of one inch of mercury absolute, the Btu through the turbine as compared to total Btu is 42.55%.

Thus, the heat recovery systems of FIGS. 1 and 2 achieve results using a delta T of 250° F. comparable to a steam cycle using a delta T of 850° F. Accordingly, the heat recovery system of the present invention is suitable for heat recovery applications wherein delta T is too small for other energy recovery.

For mathematical analysis of the system of FIG. 1 for the temperatures previously cited (350° F. hot, 100° F. cold and 15° F. drop to intermediate) let it be assumed that chamber 10 together with its associated heat exchangers 16, 24 and 32 have a total volume of 250 cubic feet, that the same volume is assumed for chamber 36 and its associated heat exchangers 42, 50 and 58, and the turbine volume is 5 cubic feet. Initially the system is assumed to be at a temperature of 100° F. and at a pressure of 300 psi throughout all components. Assuming the gas to be air the system will contain a total of 732 pounds of air. Each cycle 132 pounds of air will flow through the turbine from chamber 10 to chamber 36 and then back from chamber 36 to chamber 10 sending 15,597 Btu through the turbine. Each cycle 296 pounds of air is cooled twice, resulting in heat wasted. With intermediate temperature assumed at 240° F. (average hot and cold temperature plus 15° F.), the heat wasted to the cold heat exchanger is 19,949 Btu per cycle. Without intermediate temperature heat exchangers the heat wasted is 35,744 Btu. If this system is designed for 100 kw output it would operate at about 165 seconds per cycle and produce two power pulses per cycle.

As stated above, the two chamber systems illustrated in FIGS. 1 and 2 of the drawings produce power in intermittent pulses. Substantially uniform power may be achieved by combining two or more of the two chamber systems described.

Referring now to FIG. 3 of the drawing, the heat recovery system of this invention may also be applied to a piston engine. Thus, there is illustrated a piston engine housing 144 which defines an elongated cylinder chamber 146 having a closed end 148 and an open end 150. Reciprocated in the cylinder chamber is a piston 152 which is connected by piston rod 154 to a crankshaft 156 of a work-producing device.

A blower 158 is mounted within the cylinder between the closed end 148 and the piston 152. In the manner of the blowers previously described in connection with FIGS. 1 and 2, the blower 158 serves to move gases within the cylinder through heat exchangers.

Hot heat exchanger 160 is provided with a heat transfer fluid circulating section the inlet conduit 162 of which is arranged for communication with a source of hot transfer fluid, preferably a source of waste heat, and a return conduit 164 for the recirculation or exhaust of such heat transfer fluid. The heat exchanger also is provided with a heat exchange passageway section the opposite ends of which communicate through ports 166 and 168 in the housing 144 with the cylinder chamber 146.

In similar manner, a cool heat exchanger 170 is provided with a heat transfer fluid circulating section the inlet conduit 172 of which communicates with a source of fluid coolant and the outlet conduit 174 of which provides for recirculating or exhausting the coolant fluid. The heat exchanger also is provided with a heat exchange passageway section the opposite ends of which communicate through ports 176 and 178 in the housing 144 with the cylinder chamber 146.

Control valve means is provided for controlling the circulation of gases within the cylinder chamber 146 through the heat exchangers. In the embodiment illustrated, the inner end of the hollow piston is open to the chamber, and the piston wall is provided with a hot gas control port 180 arranged for registration with the port 168 when the piston is in its position of maximum retraction within the cylinder, i.e. its closest position to the closed end 148 of the cylinder. The piston also includes cool gas port 182 which is arranged for registration with the port 178 for the cool heat exchanger, when the piston is in its position of maximum extension from the cylinder 146, i.e. its position farthest removed from the closed end 148.

In the operation of the piston engine illustrated in FIG. 3, let it be assumed that the piston 152 retracts into the cylinder 146 until the port 180 aligns with port 168. The blower thus circulates the gases within the cylinder through the hot heat exchanger 160, thereby increasing the pressure within the cylinder relative to the pressure outside the piston. The piston thus is driven downward away from the closed end 148 until the port 182 registers with the port 178. The blower then moves the gases within the cylinder through the cool heat exchanger 170. The gases within the cylinder thus are cooled and the pressure within the cylinder decreases to a magnitude below the atmospheric or other pressure outside the piston. Thereupon the piston is pushed into the cylinder 146 until the piston port 180 once again registers with the port 168 of the hot heat exchanger to initiate a repetition of the operating cycle described hereinbefore.

It is to be noted that the engine will operate to rotate the crankshaft 156 in either direction it is initiated.

It will be recognized that the gas pressure within the chamber 146 is related to atmospheric or other pressure outside the chamber, rather than to the gas pressure in a second chamber of a pair as in the embodiments of FIGS. 1 and 2. In this regard, the system illustrated in FIG. 3 is not pressurized so that pressure outside the cylinder and piston is at atmospheric pressure. In a pressurized system the pressure below the piston will be the average of the high and low pressures above the piston.

A more complex version of FIG. 3 may be provided in which two cylinders are arranged to operate at 90° phase displacement and have electrically operated valves which are externally controlled. Such an engine has the virtue that it is self starting in either direction, depending upon the timing of the valves. Such an engine also may be pressurized using only a shaft seal, or as an electrical generating unit which may be completely hermetically sealed by enclosing the generator within the sealed unit.

From the foregoing description it will be appreciated that although the heat recovery system of this invention is based upon the principle of the Stirling engine, the substitution herein of a blower, valve and heat exchanger system for the conventional Stirling displacer allows this invention to be expanded to large size, affords rapid control response and enables the use of efficient finned heat exchangers.

It will be apparent to those skilled in the art that various modifications and changes may be made in the size, shape, type, number and arrangement of parts described hereinbefore. For example, the valve 14, 22, 30, 40, 48 and 56 may be replaced by individual electrically controlled blowers which perform the same control function as the valves illustrated. Accordingly, the term "valve means" employed in the appended claims is intended to include such blowers or any other means which performs the same control function.

As another example, if physical arrangement permits, the intermediate temperature heat exchangers 32 and 58 of FIG. 1 and the intermediate temperature heat exchangers 106 and 124 of FIG. 2 may be combined into a single unit, eliminating the need for the recirculating system and pump. To illustrate, heat exchanger 58 (FIG. 1) may be removed, valve 56 coupled to conduit 64, pump 66 omitted, and conduit 62 coupled to conduit 60. In similar manner, heat exchanger 124 (FIG. 2) may be removed, valve 122 coupled to conduit 130, pump 132 omitted, and conduit 128 coupled to conduit 126. By this means heat is exchanged directly between the chamber being heated and the chamber being cooled.

As another example, the intermediate temperature heat exchangers shown in FIGS. 1 and 2 may be replaced with sump type heat exchangers in which a heat transfer fluid is retained in each heat transfer fluid section and is not circulated between heat exchangers, as distinguished from the systems of FIGS. 1 and 2 wherein heat transfer fluid is circulated by the pumps 66 and 132.

As still another example, the embodiment of FIG. 3 may be modified by removing the piston ports 180 and 182, shortening the piston 152 so that the cylinder ports 168 and 178 are not closed by the piston throughout its range of reciprocation, and inserting an electrically controlled valve between the ports 166 and 168 and another electrically controlled valve between the ports 176 and 178. Additionally, the heat exchange passageway of an intermediate temperature heat exchanger, preferably of the sump type, may be cuopled, through an electrically controlled valve, to the ports 166 and 168, in parallel with the associated hot heat exchanger 160, or to the ports 166 and 168, in parallel with the associated cool heat exchanger 170. Such a sump type heat exchanger functions to store heat prior to cooling the gas above the piston 152 and to restore the heat prior to heating the gas above the piston, for increased efficiency.

The foregoing and other changes may be made without departing from the spirit of this invention and the scope of the appended claims.

Having now described my invention and the manner in which it may be used, I claim:

1. A heat recovery system, comprising:

(a) first and second gas chambers, (b) hot gas heat exchanger means having a heat transfer fluid circulating section and a heat exchange passageway section, (c) means for coupling the circulating section of the hot gas heat exchanger means to a source of hot heat transfer fluid, (d) cool gas heat exchanger means having a heat transfer fluid circulating section and a heat exchange passageway section, (e) means for coupling the circulating section of the cool gas heat exchanger means to a source of cool heat transfer fluid, (f) blower means coupling the gas chambers with the heat exchange passageway sections of the hot and cool gas heat exchanger means, (g) valve means for selectively opening and closing communication between the gas chambers and the heat exchange passageway sections of the hot and cool gas heat exchanger means, (h) the valve means being operable alternately to open communication between the first gas chamber and the heat exchange passageway section of the hot gas heat exchanger means to increase the gas pressure in the first gas chamber while simultaneously opening communication between the second gas chamber and the heat exchange passageway section of the cool gas heat exchanger means to lower the gas pressure in the second gas chamber, and to open communication between the first gas chamber and the heat exchange passageway section of the cool gas heat exchanger means to lower the gas pressure in the first gas chamber while simultaneously opening communcation between the second gas chamber and the heat exchange passageway section of the hot gas heat exchanger means to increase the gas pressure in the second gas chamber, (i) a high pressure gas outlet arranged for connection to a gas pressure-operated work-performing device, (j) first and second outlet valve means communicating the first and second gas chambers, respectively, with the high pressure gas outlet, and (k) first and second return valve means communicating the outlet of the gas pressure-operated work-performing device with the first and second gas chambers to return exhaust pressure gas from the outlet of the work-performing device to the lower pressure gas chamber.

2. The heat recovery system of claim 1 wherein the first and second outlet valve means comprise check valves arranged to allow gas flow from each gas chamber toward the high pressure gas outlet and the first and second return valve means comprise check valves arranged to allow exhaust gas flow from the outlet of the work-performing device to the lower pressure gas chamber.

3. The heat recovery system of claim 1 wherein the high pressure gas outlet is arranged for connection to the input of a turbine and the exhaust outlet of the turbine is arranged for communication through the return valve means with the lower pressure gas chamber.

4. The heat recovery system of claim 1 wherein, (a) the hot gas heat exchanger means comprises a single heat exchanger and the valve means selectively opens and closes communication between the heat exchange passageway section of the single hot gas heat exchanger and one of the gas chambers while simultaneously closing and opening communication between the heat exchange passageway section of the hot gas heat exchanger and the other gas chamber; and (b) the cool gas heat exchanger means comprises a single heat exchanger and the valve means selectively opens and closes communication between the heat exchange passageway section of the single cool gas heat exchanger and said other of the gas chambers while simultaneously closing and opening communication between the heat exchange passageway section of the cool gas heat exchanger and the said one gas chamber.

5. The heat recovery system of claim 1 wherein, (a) the hot gas heat exchanger means comprises a pair of heat exchangers, one associated with each gas chamber, and the valve means selectively opens and closes communication between the heat exchange passageway section of each hot gas heat exchanger and its associated gas chamber while simultaneously closing and opening communication between the heat exchange passageway section of the hot gas heat exchanger and the associated other gas chamber, and (b) the cool gas heat exchanger means comprises a pair of heat exchangers one associated with each gas chamber, and the valve means selectively opens and closes communication between the heat exchange passageway section of each cool gas heat exchanger and its associated gas chamber while simultaneously closing and opening communication between the heat exchange passageway section of the cool gas heat exchanger and its associated other gas chamber.

6. The heat recovery system of claim 1 including an intermediate temperature gas heat exchanger associated with each gas chamber, each having a heat transfer fluid section and a heat exchange passageway section, and valve means for selectively opening and closing communication between the heat exchange passageway section and its associated gas chamber.

7. The heat recovery system of claim 1 including an intermediate temperature gas heat exchanger associated with each gas chamber, each having a heat transfer fluid circulating section and a heat exchange passageway section, valve means for selectively opening and closing communication between the heat exchange passageway section of each intermediate temperature gas heat exchanger and its associated gas chamber, conduit means coupling the heat transfer fluid sections of both intermediate temperature gas heat exchangers together, and pump means in the conduit means for circulating the heat transfer fluid between said circulating sections.

8. A heat recovery system, comprising:

(a) a first and second gas chambers, (b) a hot gas heat exchanger having a heat transfer fluid circulating section and a heat exchange passageway section, (c) means for coupling the circulating section of the hot gas heat exchanger to a source of hot heat transfer fluid, (d) a cool gas heat exchanger having a heat transfer fluid circulating section and a heat exchange passageway section, (e) means for coupling the circulating section of the cool gas heat exchanger to a source of cool heat transfer fluid, (f) first blower means coupling the first gas chamber with the heat exchange passageway section of the first hot and cool gas heat exchangers, (g) second blower means coupling the second gas chamber with the heat exchange passageway section of the second hot and cool gas heat exchangers, (h) valve means for selectively opening and closing communication between the gas chambers and the heat exchange passageway sections of the hot and cool gas heat exchangers, (i) the valve means being operable alternately to open communication between the first gas chamber and the heat exchange passageway of the hot gas heat exchanger to increase the gas pressure in the first gas chamber while simultaneously opening communication between the second gas chamber and the heat exchange passageway section of the cool gas heat exchanger to lower the gas pressure in the second gas chamber, and to open communication between the first gas chamber and the heat exchange passageway section of the cool gas heat exchanger to lower the gas pressure in the first gas chamber while simultaneously opening communication between the second gas chamber and the heat exchange passageway section of the hot gas heat exchanger to increase the gas pressure in the second gas chamber, (j) a high pressure gas outlet arranged for connection to a gas pressure-operated work-performing device, (k) first and second outlet valve means communicating the first and second gas chambers, respectively, with the high pressure gas outlet, the first and second outlet valve means comprising check valves arranged to allow gas flow from each gas chamber toward the high pressure gas outlet, and (l) first and second return valve means communicating the outlet of the work-performing device with the first and second gas chambers to return exhaust pressure gas from the outlet of the work-performing device to the lower pressure gas chamber, the first and second return valve means comprising check valves arranged to allow exhaust gas flow from the outlet of the work-performing device to the lower pressure gas chamber.

9. The heat recovery system of claim 8 including an intermediate temperature gas heat exchanger associated with each gas chamber, each having a heat transfer circulating section and a heat exchange passageway section, valve means for seletively opening and closing communication between the heat exchange passageway section of each intermediate temperature gas heat exchanger and its associated gas chamber, conduit means coupling the heat transfer fluid circulating sections of both intermediate temperature gas heat exchangers together, and pump means in the conduit means for circulating a heat transfer fluid between said circulating sections.

10. A heat recovery system, comprising:

(a) first and second gas chambers, (b) a first hot gas heat exchanger having a heat transfer fluid circulating section and a heat exchange passageway section, (c) a second hot gas heat exchanger having a heat transfer fluid circulating section and a heat exchange passageway section, (d) means for coupling the circulating section of the first and second hot gas heat exchangers to a source of hot heat transfer fluid, (e) a first cool gas heat exchanger having a heat transfer fluid circulating section and a heat exchange passageway section, (f) a second cool gas heat exchanger having a heat transfer fluid circulating section and a heat exchange pasageway section, (g) means for coupling the circulating section of the first and second cool gas heat exchangers to a source of cool heat transfer fluid, (h) first blower means coupling the first gas chamber with the heat exchange passageway section of the first hot and cool gas heat exchangers, (i) second blower means coupling the second gas chamber with the heat exchange passageway section of the second hot and cool gas heat exchangers, (j) valve means for selectively opening and closing communication between the gas chambers and the heat exchange passageway sections of the hot and cool gas heat exchangers, (k) the valve means being operable alternately to open communication between the first gas chamber and the heat exchange passageway section of the associated hot gas heat exchanger to increase the gas pressure in the first gas chamber while simultaneously opening communication between the second gas chamber and the heat exchange passageway section of the associated cooled gas heat exchanger to lower the gas pressure in the second gas chamber, and to open communication between the first gas chamber and the heat exchange passageway section of the associated cool gas heat exchanger to lower the gas pressure in the first gas chamber while simultaneously opening communication between the second gas chamber and the heat exchange passageway section of the associated hot gas heat exchanger to increase the gas pressure in the second gas chamber, (l) a high pressure gas outlet arranged for connection to a gas pressure-operated work-performing device, (m) first and second outlet valve means communicating the first and second gas chambers, respectively, with the high pressure gas outlet, the first and second outlet valve means comprising check valves arranged to allow gas flow from each gas chamber toward the high pressure gas outlet, and (n) first and second return valve means communicating the outlet of the work-performing device with the first and second gas chambers to return exhaust pressure gas from the outlet of the work-performing device to the lower pressure gas chamber, the first and second return valve means comprising check valves arranged to allow exhaust gas flow from the outlet of the work-performing device to the lower pressure gas chamber.

11. The heat recovery system of claim 10 including an intermediate temperature gas heat exchanger associated with each gas chamber, each having a heat transfer fluid circulating section and a heat exchange passageway section, valve means for selectively opening and closing communication between the heat exchange passageway section of each intermediate temperature gas heat exchanger and its associated gas chamber, conduit means coupling the heat transfer circulating sections of both intermediate temperature gas heat exchangers together, and pump means in the conduit means for circulating a heat transfer fluid between said circulating section.

12. A heat recovery system, comprising:

(a) first and second separate chambers for containing a gas therein, (b) hot gas heat exchanger means associated with each of said chambers and having a heat transfer fluid circulating section and a heat exchange passageway section, (c) means for coupling the circulating section of each hot gas heat exchanger means to a source of hot heat transfer fluid, (d) cool gas heat exchanger means associated with each of said chambers and having a heat transfer fluid circulating section and a heat exchange passageway section, (e) means for coupling the circulating section of each cool gas heat exchanger means to a source of cool heat transfer fluid, (f) blower means associated with the chambers for moving gas therein through the heat exchange passageway sections of the hot and cool gas heat exchanger means, (g) valve means for selectively opening and closing communication between the gas chambers and the heat exchange passageway sections of the hot and cool gas heat exchanger means, the valve means being operable alternately to open communication between the said first gas chamber and the heat exchange passageway section of the associated hot gas heat exchanger means to increase the gas pressure in the said first gas chamber while simultaneously opening communication between the said second gas chamber and the heat exchange passageway of the associated cool gas heat exchanger means to lower the gas pressure in the said second gas chamber, and to open communication between the said first gas chamber and the heat exchange passageway section of the associated cool gas heat exchanger means to lower the gas pressure in the said first gas chamber while simultaneously opening communication between the said second gas chamber and the heat exchange passageway section of the associated hot gas heat exchanger means to increase the gas pressure in the said other gas chamber, and (h) a high pressure gas outlet arranged for connection to a gas pressure-operated work-performing device, (i) first and second outlet valve means communicating the first and second gas chambers, respectively, with the high pressure gas outlet, and (j) first and second return valve means communicating the outlet of a gas pressure-operated work-performing device with the first and second gas chambers to return exhaust pressure gas from the outlet of the work-performing device to the lower pressure gas chamber.

13. A heat recovery system, comprising:

(a) chamber means for containing a gas therein, (b) hot gas heat exchanger means having a heat transfer fluid circulating section and a heat exchange passageway section, (c) means for coupling the circulating section of the hot gas heat exchanger means to a source of hot heat transfer fluid, (d) cool gas heat exchanger means having a heat transfer fluid circulating section and a heat exchange passageway section, (e) means for coupling the circulating section of the cool gas heat exchanger means to a source of cool heat transfer fluid, (f) blower means associated with the chamber means for moving gas therein through the heat exchange passageway sections of the hot and cool gas heat exchanger means, (g) valve means for selectively opening and closing communication between the chamber means and the heat exchange passageway sections of the hot and cool gas heat exchanger means, the valve means being operable alternately to open communication between the chamber means and the heat exchange passageway section of the hot gas heat exchanger means to increase the gas pressure in the chamber means relative to the pressure outside the chamber means, and to open communication between the chamber means and the heat exchange passageway section of the cool gas heat exchanger means to lower the gas pressure in the chamber means relative to the pressure outside the chamber means, (h) intermediate temperature gas heat exchanger means associated with the chamber means having a heat transfer section and a heat exchange passageway section, and (i) valve means for selectively opening and closing communication between said heat exchange passageway section of the intermediate temperature gas heat exchanger means and the chamber means.

* * * * *